United States Patent [19]

Abel

[11] 4,273,554

[45] Jun. 16, 1981

[54] PROCESS FOR DYEING TEXTILE CELLULOSE MATERIAL WHICH HAS NOT BEEN PRE-CLEANED

[75] Inventor: Heinz Abel, Reinach, Switzerland

[73] Assignee: Ciba-Geigy Corporation, Ardsley, N.Y.

[21] Appl. No.: 108,856

[22] Filed: Dec. 31, 1979

[30] Foreign Application Priority Data

Jan. 10, 1979 [CH] Switzerland ..... 218/79

[51] Int. Cl.[3] ..... C09B 67/00; C09B 67/28

[52] U.S. Cl. ..... 8/557; 8/650; 8/680; 8/918

[58] Field of Search ..... 8/92, 54.2, 34, 18 R, 8/557, 650, 680, 918

[56] References Cited

U.S. PATENT DOCUMENTS

| | | | |
|---|---|---|---|
| 3,940,247 | 2/1976 | Sthare et al. | 8/92 |
| 4,036,587 | 7/1977 | Wolf et al. | 8/92 |
| 4,055,393 | 10/1977 | Schafer et al. | 8/62 |
| 4,095,942 | 6/1978 | Dellian et al. | 8/92 |

FOREIGN PATENT DOCUMENTS

| | | |
|---|---|---|
| 2557556 | 6/1977 | Fed. Rep. of Germany . |
| 1369429 | 10/1974 | United Kingdom . |
| 1411063 | 10/1975 | United Kingdom . |

*Primary Examiner*—A. Lionel Clingman
*Attorney, Agent, or Firm*—Edward McC. Roberts

[57] ABSTRACT

Cellulose fiber material which has not been pre-cleaned, in particular raw cotton, is dyed with vat dyes or anionic dyes in the presence of a homopolymer of maleic acid, especially in the presence of hydrolysed polymaleic anhydride; level dyeings are obtained and the cellulose material is free from lime deposits and creases and has perfect levelness and a soft handle.

19 Claims, No Drawings

PROCESS FOR DYEING TEXTILE CELLULOSE MATERIAL WHICH HAS NOT BEEN PRE-CLEANED

The present invention relates to a novel process for dyeing textile cellulose material, which has not been pre-cleaned, with vat dyes or anionic dyes and to the cellulose material dyed by means of this process.

The process according to the invention comprises dyeing the cellulose material in the presence of polymaleic acid or of an anhydride or salt thereof.

Preferably, hydrolysed polymaleic anhydride, which advantageously has a molecular weight of 300 to 5,000, or a water-soluble salt of such a polymaleic anhydride is employed. These polymers are suitable as dyeing assistants when dyeing cellulose material and are particularly suitable as complexing agents for binding the impurities or natural constituents, for example calcium salts and magnesium salts, which are present, for example, in the cellulose material, in particular in the raw cotton.

Polymaleic anhydride is essentially a homopolymer of maleic anhydride and can be hydrolysed very easily, for example by heating with water, with the formation of a polymeric product which contains free carboxylic acid groups and also, in some cases, some residual anhydride groups on a main carbon chain. The product is not a pure polymaleic acid. The precise constitution of the product is not known. Therefore, within the framework of this invention, this polymeric product formed by hydrolysis of polymaleic anhydride is termed hydrolysed polymaleic anhydride. This hydrolysed polymaleic anhydride can be prepared from a polymer obtained by addition polymerisation from a starting monomer essentially consisting of maleic anhydride, under conditions for polymerisation in bulk or by solution polymerisation. Preferably, maleic anhydride is polymerised in an inert organic solvent, such as toluene or xylene, in the presence of a polymerisation catalyst, especially of a free radical initiator, such as benzoyl peroxide, di-(tertiary butyl) peroxide or mono-butyl hydroperoxide, at temperatures of up to 150° C., for example 120° to 145° C. The main chain of the primary polymer is essentially formed by non-hydrolysable bonds. After it has been freed from unconverted monomer and other non-polymeric types of molecules, the primary, unhydrolysed polymer product is then hydrolysed with water or a water-soluble alkali, either before it is used or by incorporating it in an aqueous medium for application.

Decarboxylation of the polymer can take place during the polymerisation reaction or during the subsequent hydrolysis, so that the acid number found for the hydrolysed polymaleic anhydride is lower than the theoretical value of 1,143 mg of KOH/g; however, such decarboxylation does not proceed to such an extent that the acid number falls below 350 mg of KOH/g. The acid number can be determined by potentiometric titration in aqueous solution against 0.1 N potassium hydroxide solution, $\Delta pH:\Delta V$ being plotted graphically against V and the highest peak being regarded as the end point; $\Delta pH$ is the change in pH, $\Delta V$ is the change in volume and V is the volume titrated.

It is important that the molecular weight of the hydrolysed polymaleic anhydride is within the indicated low range. Preferably, the polymaleic anhydride used has a molecular weight which does not exceed 2,000 and preferably is within the range of 350 to 1,000.

As a rule, the molecular weight of the polymaleic anhydride is determined by calculation, by osmometric measurement of the polymaleic anhydride prior to hydrolysis.

Further details with regard to the nature of the hydrolysed polymaleic anhydride, including its preparation, are described in British Patent Specifications Nos. 1,369,429 and 1,411,063.

The carboxyl groups in the hydrolysed polymaleic anhydride can be in the form of free acid groups or in the form of water-soluble salt groups, for example alkali metal salts or ammonium salts. Suitable alkali metal salts are, in particular, the sodium or potassium salt and suitable ammonium salts are the ammonium, trimethylammonium, monoethanolammonium, diethanolammonium or triethanolammonium salt. The sodium or ammonium salt is preferred.

The amounts in which the hydrolysed polymaleic anhydride is added to the dye liquor vary between 0.1 and 3 g, preferably between 0.5 and 1.5 g, per liter of liquor, based on the solids content of the anhydride.

The hydrolysed polymaleic anhydride can be used on its own or in combination with a further dyeing assistant or textile assistant. The combination is preferably made up in the form of an aqueous preparation. Further assistants which can be used are, for example, antistatic agents, diffusion accelerators, dispersing agents, levelling agents, emulsifiers, de-aerating agents, anti-crease agents, wetting agents, antifoams, detergents and/or agents for imparting a soft handle. The amounts in which the further assistants are added, in addition to the hydrolysed polymaleic anhydride, to the dye liquor vary, depending on their solids content, between 0.05 and 3 g and preferably between 0.2 and 1 g per liter of liquor.

An advantageous embodiment of the invention comprises dyeing the cellulose material in the presence of an aqueous preparation which contains the hydrolysed polymaleic anhydride and a dispersing agent, levelling agent, anti-crease agent, wetting agent and/or detergent. Particularly preferred formulations contain the hydrolysed polymaleic anhydride and a levelling agent or anti-crease agent.

The preparations can be produced by simply stirring the said components. With the addition of water and, if desired, a base, for example alkali metal hydroxides such as sodium hydroxide or potassium hydroxide, aqueous ammonia, lower alkanolamines, such as monoethanolamine, diethanolamine or triethanolamine, or morpholine or pyridine, they are obtained in the form of homogeneous, preferably clear mixtures which have very good stability on storage at room temperature. The preparations advantageously contain 40 to 70 percent by weight of hydrolysed polymaleic anhydride, 0 to 50 and preferably 5 to 50 percent by weight of a further assistant or mixture of assistants, 5 to 40 percent by weight of water and 0 to 30 percent by weight of a base, the percentages in each case being based on the preparation.

Suitable assistants, which at the same time act as levelling agents and anti-crease agents and can be employed successfully in combination with the hydrolysed polymaleic anhydride, are in particular polypropylene oxide adducts, or salts thereof, which contain carboxyl groups and have been prepared from (a) an aliphatic diol which has an average molecular weight of not more than 2,600, (b) an aliphatic dicarboxylic acid, or its anhydride, having 4 to 10 carbon atoms, (c) an adduct of propylene oxide with an aliphatic alcohol which is at least trihydric and has 3 to 10 carbon atoms and (d) a fatty acid having 8 to 22 carbon atoms.

These polypropylene oxide adducts can be in the form of free acids or in the form of salts, especially in the form of sodium salts or ammonium salts.

Preferably, the polypropylene oxide adduct containing carboxyl groups is built up from 1 to 3 mols, preferably 1 mol, of component (a), 2 to 4 mols, preferably 2 mols, of component (b), 1 mol of component (c) and 1 to 2 mols of component (d).

Component (a) is preferably a diol of the formula $$HO-(CH_2-CH_2-O)_n-H \quad (1)$$

in which n is 1 to 50 and preferably 10 to 40. Examples of such diols are ethylene glycol, diethylene glycol or polyethylene glycols with an average molecular weight of 450 to 2,300 and especially 650 to 1,800. Further aliphatic diols can also be 1,3- or 1,2-propylene glycol or 1,5-pentanediol.

The aliphatic dicarboxylic acids of component (b) can be saturated or ethylenically unsaturated. Examples of suitable aliphatic, saturated dicarboxylic acids are succinic acid, glutaric acid, adipic acid, pimelic acid, suberic acid, azelaic acid or sebacic acid, or their anhydrides, especially succinic anhydride or glutaric anhydride.

Ethylenically unsaturated dicarboxylic acids are preferably fumaric acid, maleic acid or itaconic acid, and also mesaconic acid, citraconic acid and methylenemalonic acid. A suitable anhydride of these acids is in particular maleic anhydride, and this is also the preferred component (b).

Component (c) is in particular an adduct of propylene oxide with a trihydric to hexahydric alkanol having 3 to 6 carbon atoms. These alkanols can be straight-chain or branched. Examples are glycerol, trimethylolpropane, erythritol, pentaerythritol, mannitol or sorbitol.

The reaction products of component (c) can be prepared, for example, by adding about 2 to 20 mols, and preferably 4 to 12 mols, of propylene oxide onto 1 mol of the trihydric to hexahydric alcohol.

Adducts of 4 to 8 mols of propylene oxide with 1 mol of pentaerythritol have proved particularly suitable.

The fatty acids of component (d) are saturated or unsaturated acids, for example caprylic acid, capric acid, lauric acid, myristic acid, palmitic acid, stearic acid, arachic acid, ($C_{10}$–$C_{16}$)-coconut fatty acid, tallow fatty acid, behenic acid, decenoic acid, dodecenoic acid, tetradecenoic acid, hexadecenoic acid, oleic acid, linoleic acid, linolenic acid, ricinoleic acid, eicosenoic acid, docosenoic acid or clupanodonic acid.

Oleic acid, coconut fatty acid, tallow fatty acid, palmitic acid or, in particular, stearic acid are of primary interest.

Preferred polypropylene oxide adducts are obtained from the following components: ($a_1$) an aliphatic diol of the formula (2)

$$HO-(CH_2CH_2O)_{n_1}-H$$

in which $n_1$ is 10 to 40, preferably polyethylene glycols with an average molecular weight of 900 to 1,800 and especially 1,500 to 1,600, ($b_1$) a saturated or ethylenically unsaturated aliphatic dicarboxylic acid, or its anhydride, having 4 to 10 carbon atoms, especially maleic anhydride, ($c_1$) an adduct of propylene oxide with trihydric to hexahydric alkanols having 3 to 6 carbon atoms and ($d_1$) a saturated or unsaturated fatty acid having 12 to 22 carbon atoms, especially coconut fatty acid, oleic acid, palmitic acid and in particular stearic acid.

A typical representative of these adducts is the reaction product of 1 mol of the condensation product of 1 mol of pentaerythritol and 4 to 8 mols of propylene oxide, with 2 mols of maleic anhydride, 1 mol of polyethylene glycol with an average molecular weight of 1,500 and 1 mol of stearic acid.

The polypropylene oxide adducts are prepared by known methods. One process for the preparation of these products comprises reacting component (a) with components (b), (c) and (d) and, if desired, converting the product into a salt. The reaction of component (a) with components (b), (c) and (d) is carried out at temperatures of 80° to 150° C. and preferably of 90° to 130° C., if desired in the presence of an acid catalyst and/or of an organic solvent which is inert towards the reactants. The catalyst used can be, for example, sulfuric acid or p-toluenesulfonic acid. Suitable organic solvents are, for example, benzene, toluene or xylene.

When dicarboxylic acids are used as component (b), the various components can be reacted at the same time. If anhydrides of aliphatic dicarboxylic acids are employed as component (b), the esterification is advantageously carried out stepwise. In a first step, for example, the diol (component a) is reacted in the presence of a polymerisation inhibitor, for example di-(tert.-butyl)-p-cresol, with the anhydride by warming to 90° to 130° C. to give the bis-monoester of the dicarboxylic acid and this acid is then further esterified, in a second step, with the addition of an acid catalyst and if desired in the presence of an inert organic solvent, for example benzene or toluene, with the adduct of component (c) and a fatty acid (component d) at 90° to 130° C., after which the ester product, which still contains carboxyl groups, can be converted into a salt by the addition of bases, such as ammonia or alkali metal hydroxides.

The dispersing agents which are used if desired are preferably formaldehyde condensation products of aromatic sulfonic acids, formaldehyde and, if desired, monofunctional or bifunctional phenols, for example of cresol, β-naphtholsulfonic acid and formaldehyde, of benzenesulfonic acid, formaldehyde and naphthalenesulfonic acid, of naphthalenesulfonic acid and formaldehyde or of naphthalenesulfonic acid, dihydroxydiphenylsulfone and formaldehyde.

Anionic or non-ionic surfactants can also be employed as dispersing agents and these can be present on their own or as mixtures of anionic or of non-ionic surfactants or as mixtures consisting of an anionic surfactant and a non-ionic surfactant.

Examples of suitable anionic surfactants are: sulfated aliphatic alcohols, the alkyl chain of which has 8 to 18 carbon atoms, for example sulfated lauryl alcohol; sulfated, unsaturated fatty acids or fatty acid lower alkyl esters which contain 8 to 20 carbon atoms in the fatty radical, for example ricinoleic acid and oils containing such fatty acids, for example castor oil; alkylsulfonates in which the alkyl chain contains 8 to 20 carbon atoms, for example dodecylsulfonate; alkylarylsulfonates with a straight-chain or branched alkyl chain having at least 6 carbon atoms, for example dodecylbenzenesulfonates or 3,7-diisobutyl-naphthalenesulfonates; sulfonates of polycarboxylic acid esters, for example dioctylsulfosuccinates; the alkali metal, ammonium or amine salts of fatty acids having 10 to 20 carbon atoms which are termed soaps, for example colophony salts; esters of polyalcohols, especially monoglycerides or diglycerides of fatty acids having 12 to 18 carbon atoms, for example monoglycerides of lauric acid, stearic acid or oleic acid; and the adducts of 1 to 60 mols of ethylene oxide and/or propylene oxide with fatty amines, fatty acids or fatty alcohols, each having 8 to 22 carbon atoms, with alkylphenols having 4 to 16 carbon atoms in the alkyl chain or with trihydric to hexahydric alkanols having 3 to 6 carbon atoms, which adducts have been converted to an acid ester using an organic dicarboxylic acid, for example maleic acid, malonic acid or sulfosuccinic acid, but preferably using an inorganic polybasic acid, such as o-phosphoric acid or in particular sulfuric acid.

Anionic dispersing agents which have proved particularly advantageous are ligninsulfonates, polyphosphates and preferably formaldehyde condensation products of aromatic sulfonic acids, formaldehyde and, if desired, monofunctional or bifunctional phenols, for example of cresol, β-naphtholsulfonic acid and formaldehyde, of benzenesulfonic acid, formaldehyde and naphthalenesulfonic acid, of naphthalenesulfonic acid and formaldehyde or of naphthalenesulfonic acid, dihydroxydiphenylsulfone and formaldehyde. In addition, the disodium salt of di-6-sulfonaphthyl-2-methane is preferred.

Mixtures of anionic dispersing agents can also be used. The anionic dispersing agents are usually in the form of their alkali metal salts, ammonium salts or amine salts.

Examples of non-ionic surfactants are: adducts of preferably 5 to 80 mols of alkylene oxides, in particular ethylene oxide, it being possible for individual ethylene oxide units to be replaced by substituted epoxides, such as styrene oxide and/or propylene oxide, with higher unsaturated or saturated fatty alcohols, fatty acids, fatty amines or fatty amides having 8 to 22 carbon atoms or with phenylphenol or alkylphenols in which the alkyl radicals have at least 4 carbon atoms; alkylene oxide condensation products, especially ethylene oxide and/or propylene oxide condensation products; and reaction products of a fatty acid having 8 to 22 carbon atoms and a primary or secondary amine containing at least one hydroxy-lower alkyl or lower alkoxy-lower alkyl group, or alkylene oxide adducts of these reaction products containing hydroxyalkyl groups, the reaction being carried out in such a way that the molecular ratio between the hydroxy-alkylamine and the fatty acid can be 1:1 and higher than 1, for example 1.1:1 to 2:1.

The anionic and non-ionic surfactants mentioned can also be used as wetting agents and detergents and in some cases also as levelling agents or emulsifiers.

Suitable cellulose material is in particular natural cellulose which has not been pre-treated, for example hemp, linen, jute, natural cellulose fibre and in particular raw cotton, and also fibre blends, for example those of polyacrylonitrile/cotton or polyester/cotton, in which case the polyacrylonitrile and polyester in the blend is dyed, beforehand, at the same time or subsequently, with cationic or disperse dyes. The cellulose material can be in very diverse stages of processing, for example in the form of loose material, yarn, woven fabrics or knitted fabrics.

The vat dyes are higher fused and heterocyclic benzoquinones or naphthoquinones, sulfur dyes and in particular anthraquinonoid or indigoid dyes. Examples of vat dyes which can be used according to the invention are listed in the Colour Index, 3rd Edition (1971), Volume 3 on pages 3,649 to 3,837 under the heading "Sulfur Dyes" and "Vat Dyes".

The anionic dyes are in particular the leuco vat esters, substantive dyes or in particular reactive dyes which can be used for cellulose materials.

The leuco vat esters are, for example, obtainable from vat dyes of the indigo, anthraquinone or indanthrene series by reduction, for example with iron powder, and subsequent esterification with chlorosulfonic acid, and in the Colour Index (3rd Edition, 1971, Volume 3) are termed "Solubilised Vat Dyes".

Suitable substantive dyes are the customary direct dyes, for example the "Direct Dyes" listed on pages 2,005–2,478 of the Colour Index, 3rd Edition, (1971), Volume 2.

Reactive dyes are understood as meaning the customary dyes which enter into a chemical bond with the cellulose, for example the "Reactive Dyes" listed on pages 3,391–3,560 of the Colour Index, 3rd Edition (1971), Volume 3.

Preferred dyes are the substantive dyes, leuco vat esters and in particular the vat dyes and reactive dyes.

The amount of dyes added to the dye liquor depends on the desired depth of colour. In general, amounts of 0.01 to 10 and preferably 0.01 to 3 percent by weight, based on the cellulose material employed, have proved suitable.

Depending on the dye to be used, the dye liquors can contain further customary additives, in addition to the hydrolysed polymaleic anhydride and the abovementioned assistants, for example alkali, such as sodium carbonate, sodium bicarbonate, sodium hydroxide or ammonia, or alkali donors, for example sodium trichloroacetate, and also hydrosulfite or electrolytes, for example sodium chloride or sodium sulfate. The pH value of the dye liquors is as a rule 6 to 12.5 and preferably 8 to 12.

The dyeings are advantageously carried out from an aqueous liquor by the exhaustion process. The liquor ratio is dependent on the different parameters of the apparatus, on the substrate and on the type of material. However, it can be chosen within a wide range, for example 1:4 to 1:100, but in most cases is between 1:5 and 1:40.

The process according to the invention can be carried out at temperatures of 20° to 135° C. If the material to be dyed is solely cellulose material, dyeing is advantageously carried out at a temperature of 20° to 106° C., and the temperature is preferably in the range of 30° to 95° C.

Dyeings on polyester/cotton fibre materials are preferably carried out at temperatures above 106° C. and advantageously at 110° to 135° C. These mixed fibre materials can be dyed in the presence of carriers or carrier mixtures, which act as dyeing accelerators for dyeing the polyester in the material with disperse dyes.

The dyeing process can be carried out either by first briefly treating the material to be dyed with the hydrolysed polymaleic anhydride and then dyeing or, preferably, by treating the material to be dyed with the anhydride and with the dye at the same time. The cellulose material is thus boiled out, that is to say freed from alkaline earth metal salt deposits, and dyed at the same time.

After dyeing, the dyed cellulose material can be washed in a conventional manner, in order to remove dye which has not been fixed. For this purpose, the substrate is treated, for example at 40° C. up to the boil, in a solution which contains soap or synthetic detergent.

Level and strong dyeings which are distinguished by good colour yields are obtained by the dyeing process according to the invention. In particular, level dyeings are obtained and the cellulose material is free from lime deposits and crease-free, has perfect levelness and possesses a pleasant, soft handle. The goods do not tend to produce dust.

Moreover, the use of the polymaleic anhydride has no adverse influence on the fastness properties of the dyeings, for example the fastness to light, fastness to rubbing and the wet fastness properties. Furthermore, troublesome foaming does not arise when the cellulose material is dyed in the presence of the polymaleic anhydride used according to the invention.

In the following methods of preparation and examples, the percentages are by weight, unless indicated otherwise. The amounts are based on the commercially available product in the case of the dyes, that is to say on the diluted product, and on the pure substance in the case of the assistants. The five-figure Colour Index numbers (C.I.) refer to the 3rd edition of the Colour Index.

METHODS OF PREPARATION

Method A

The hydrolysed polymaleic anhydride is prepared as follows:

100 g of maleic anhydride in 100 g of xylene are heated to 120° C. and a solution of 20 g of di-(tertiary butyl) peroxide in 50 g of xylene is added in the course of 15 minutes. The temperature of the reaction mixture is raised to 130° C. and this temperature is maintained for 5 hours. Both heating and stirring are discontinued and the polymer is allowed to precipitate from the xylene. After cooling the reaction mixture to 85° C., the lower polymer layer is separated off from the upper xylene layer. 81 g of polymer are obtained.

15 g of 2-butanone or 1,4-dioxan, as the diluent, are added to the polymer and the latter is further purified as follows. The polymer is precipitated by adding the polymer solution to 430 g of toluene stirred in a high-speed homogeniser. After filtering off and drying in vacuo at 50° C., 78 g of polymer are obtained in the form of a cream-coloured powder.

On measurement in 2-butanone with the aid of a vapour pressure osmometer, the resulting polymaleic anhydride has a molecular weight of 580.

20 g of the polymaleic anhydride are heated in 20 g of water at 90° C. for 30 minutes, after which the resulting solution is cooled to 30° C. and filtered. A solution with a solids content of 53% is obtained. Potentiometric titration of the hydrolysed polymer against potassium hydroxide gives an acid value of 560 mg of KOH/g.

Method B

The polypropylene oxide adduct containing carboxyl groups is prepared as follows:

150 g of polyethylene glycol with an average molecular weight of 1,500, 19.6 g of maleic anhydride and 0.3 g of di-(tert.-butyl)-p-cresol are heated to 130° C. and the mixture is kept at 130° C. for 3 hours, with stirring. The reflux condenser is replaced by a receiver, 60 g of a condensation product of 1 mol of pentaerythritol and 8 mols of propylene oxide, 22 g of stearic acid and 0.5 g of 98% sulfuric acid are added and the mixture is kept at 130° C. for a further 5 hours in vacuo, during which time small amounts of water are distilled off. The melt is cooled to about 60° C., 2 g of a 30% sodium hydroxide solution are added, in order to neutralise the sulfuric acid, and an ester condensation product with an acid number of 7 is obtained. The condensation product is dissolved in 580 g of water and, in order to stabilise the solution, the pH is adjusted to 6.5–7.0 by adding 30% sodium hydroxide solution. A 30% viscous solution of the polypropylene oxide adduct is obtained.

Method C

The procedure of Method B is repeated, except that 20 g of succinic anhydride are used in place of 19.6 g of maleic anhydride, and 15.6 g of coconut fatty acid are used in place of 22 g of stearic acid. A 30% viscous solution of the polypropylene oxide adduct is obtained.

Method D

The procedure of Method B is repeated, except that 100 g of polyethylene glycol with an average molecular weight of 1,000 are used in place of 150 g of polyethylene glycol 1,500. A 30% viscous solution of the polypropylene oxide adduct is obtained.

Method E

The procedure of Method B is repeated, except that 21.8 g of oleic acid are used in place of 22 g of stearic acid. A 30% viscous solution of the polypropylene oxide adduct is obtained.

Method F

The procedure of Method B is repeated, except that 10.6 g of diethylene glycol are used in place of 150 g of polyethylene glycol 1,500, and 15.6 g of coconut fatty acid are used in place of 22 g of stearic acid. A 30% viscous emulsion of the polypropylene oxide adduct containing carboxyl groups is obtained.

EXAMPLE 1

In a circulation apparatus, a cheese of 70 g of raw cotton is wetted at 30° C. in 500 ml of water. The following additives are then added to the liquor: 1 g of a preparation (1) consisting of 50% of hydrolysed polymaleic anhydride (50% free acid, according to Method A), 10% of naphthalenesulfonic acid/formaldehyde reaction product, 15% of 25% aqueous ammonia and 25% of water, 10 ml of a 30% sodium hydroxide solution, 3 g of 86% hydrosulfite and 0.5 g of a vat dye consisting of a mixture of Vat Blue 4 C.I. 69,800 and Vat Blue 6 C.I. 69,825 (1:3), which has been pre-dispersed with water and 5 ml of a 30% sodium hydroxide solution.

After uniform dispersion of the additives, the dye liquor is warmed to 60° C. in the course of 30 minutes and the cotton is dyed for 30 minutes at this temperature. 6 g of sodium chloride are then added to the dye liquor, after which the cotton is dyed for a further 30 minutes at 60° C. The dyed goods are then rinsed, warm and cold, and dried. A uniform and fast blue dyeing is obtained. The cheese is free from lime deposits. The handle is pleasantly soft.

With the same dyeing procedure but without the addition of the preparation (1), the dyed yarn has a hard handle and lime deposits and shows unlevelness.

EXAMPLE 2

On a closed winch, 100 kg of tricot of raw cotton are wetted at 30° C. in 2,500 l of water with the addition of 7,500 g of a preparation (2) consisting of 43% of hydrolysed polymaleic anhydride (50% free acid), according to Method A, 14% of 25% aqueous ammonia and 43% of the polypropylene oxide adduct (30%) prepared according to Method B. 40 l of a 30% sodium hydroxide solution and 10 kg of 86% hydrosulfite are then added to the liquor. The following stock vat is then added to the liquor: 75 l of water, 2,500 g of 86% hydrosulfite, 6 l of 30% sodium hydroxide solution, 1,000 g of the vat dye Vat Yellow 3 C.I. 67,300 and 500 g of the vat dye Vat Violet 9 C.I. 60,005.

The dye liquor is then warmed to 70° C. in the course of 30 minutes and the cotton is dyed for 30 minutes at this temperature. The dyed goods are then rinsed and oxidised in running cold water. After drying, a level dyeing results. The tricot has a pleasantly soft handle and is crease-free.

When the raw cotton is dyed in the same way but without preparation (2), the goods obtained have a hard handle and show unlevelness. Moreover, the goods tend to dust.

In place of the preparations (1) and (2) indicated in Examples 1 and 2, the following preparations (3) to (18) can also be employed with similar success:

(3) Preparation consisting of 60% of hydrolysed polymaleic anhydride according to Method A, 18% of aqueous ammonia (25%) and 22% of water (4) Preparation consisting of 60% of hydrolysed polymaleic anhydride according to Method A and 40% of water (5) Preparation consisting of 50% of hydrolysed polymaleic anhydride according to Method A, 5% of the acid phosphoric acid ester of the adduct of 10 mols of ethylene oxide and 1 mol of p-nonylphenol, 15% of aqueous ammonia (25%) and 30% of water.

(6) Preparation consisting of 50% of hydrolysed polymaleic anhydride according to Method A, 15% of aqueous ammonia (25%) and 10% of the reaction product of 80 mols of ethylene oxide and 1 mol of oleyl alcohol, and 25% of water.

(7) Preparation consisting of 50% of hydrolysed polymaleic anhydride according to Method A, 15% of aqueous ammonia (25%) and 10% of the reaction product of 1 mol of coconut fatty acid with 2 mols of di-(2-hydroxyethyl)-amine, and 25% of water.

(8) Preparation consisting of 50% of hydrolysed polymaleic anhydride according to Method A, 10% of 3,7-diisobutyl-naphthalenesulfonic acid (sodium salt), 10% of aqueous ammonia (25%) and 30% of water.

(9) Preparation consisting of 50% of hydrolysed polymaleic anhydride according to Method A, 5% of aqueous ammonia (25%) and 15% of dioctylsulfosuccinate (sodium salt) and 30% of water.

(10) Preparation consisting of 50% of hydrolysed polymaleic anhydride according to Method A, 15% of aqueous ammonia (25%) and 15% of 1-benzyl-2-heptadecyl-benzimidazole-disulfonic acid (di-sodium salt) and 20% of water.

(11) Preparation consisting of 60% of hydrolysed polymaleic anhydride according to Method A, 10% of a mixture of coconut fatty acid N,N-bis-(2-hydroxyethyl)-amide and the di-(2-hydroxyethyl)-amine salt of sulfated lauryl alcohol triglycol ether (1:1), 25% of aqueous ammonia (25%) and 5% of water.

(12) Preparation consisting of 50% of hydrolysed polymaleic anhydride according to Method A, 10% of aqueous ammonia (25%) and 10% of the reaction product of 9 mols of ethylene oxide and 1 mol of p-nonylphenol, and 30% of water.

(13) Preparation consisting of 50% of hydrolysed polymaleic anhydride according to Method A, 15% of aqueous ammonia (25%) and 10% of polyvinylpyrrolidone and 25% of water.

(14) Preparation consisting of 50% of hydrolysed polymaleic anhydride according to Method A, 15% of aqueous ammonia (25%), 10% of a reaction product of 9 mols of ethylene oxide and 1 mol of 1-methyl-2-heptadecyl-benzimidazolesulfonic acid (sodium salt) and 25% of water.

(15) Preparation consisting of 25% of hydrolysed polymaleic anhydride according to Method A, 4% of aqueous ammonia (25%), 26% of the polypropylene oxide adduct (30%) prepared according to Method B, 28% of the ammonium salt of the acid sulfuric acid ester of the adduct of 2 mols of ethylene oxide and 1 mol of nonylphenol (40%), 15% of a mixture consisting of the di-(β-hydroxyethyl)-amine salt of the acid sulfuric acid ester of the adduct of 3 mols of ethylene oxide and 1 mol of lauryl alcohol and coconut fatty acid N,N-bis-(2-hydroxyethyl)-amide (1:1) and 2% of methylpolysiloxane ethoxylate.

(16) Preparation consisting of 50% of hydrolysed polymaleic anhydride according to Method A, 20% of the phosphoric acid ester of a fatty alcohol ethoxylate, 10% of the adduct of 3 mols of ethylene oxide and 1 mol of lauryl alcohol, 5% of monoethanolamine and 15% of water.

(17) Preparation consisting of 40% of hydrolysed polymaleic anhydride according to Method A, 36% of ligninsulfonate (50%), 10% of the disodium salt of di-(6-sulfonaphth-2-yl)-methane, 5% of monoethanolamine and 9% of water.

(18) Preparation consisting of 25% of hydrolysed polymaleic anhydride according to Method A, 20% of lignin-sulfonate, 10% of the phosphoric acid ester of a fatty alcohol ethoxylate, 10% of the disodium salt of di-(6-sulfonaphth-2-yl)-methane, 15% of sodium hydroxide solution (30%) and 20% of water.

EXAMPLE 3

In a short liquor jet, 100 kg of a fabric of raw cotton are wetted in 400 l of water at 50° C. with the addition of 1,000 g of preparation (10). 300 g of the copper phthalocyanine dye of the formula $$CuPc(SO_2NHNa)_3 \quad (101)$$

are then added to the liquor. The dye liquor is then heated to the boil in the course of 30 minutes and the cotton is dyed at this temperature for 15 minutes. 2,000 g of calcined sodium sulfate are then added, after which the cotton is dyed for a further 30 minutes at the boil. The dye liquor is then cooled and the dyed goods are rinsed and dried. A level dyeing is obtained. The fabric has been cleaned, the contaminants previously present, such as alkaline earth metal salts and lubricants, having been removed. When the same procedure is repeated, but without the preparation (10), the dyeing is not level, the handle of the goods is harder and the fastness to rubbing is poorer, because of the contaminants still present.

A level dyeing with a soft handle of the goods is also obtained when the same amount of preparation (12) is employed in place of the indicated preparation (10).

EXAMPLE 4

In a beam dyeing apparatus, 100 kg of a fabric of raw cotton are wetted in 1,000 l of water at 50° C. with the addition of 3,000 g of preparation (2). 700 g of a dye of the formula

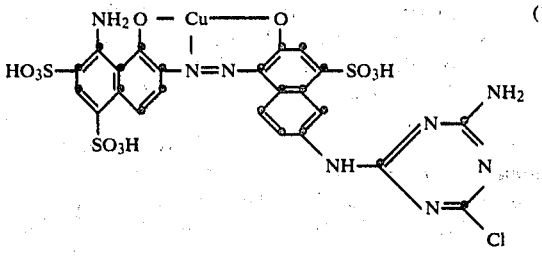
(102)

are then added in the form of a solution. The dye liquor is warmed to 80° C. in the course of 60 minutes and 4,000 g of sodium chloride are added every 10 minutes during the heating phase. After the final addition of salt, 20 kg of sodium carbonate and 3 l of sodium hydroxide solution (30%) are added to the dye liquor and the fabric is dyed for a further 45 minutes at 80° C. The liquor is then cooled and the dyed goods are rinsed.

The dyeing is rinsed, first cold for 10 minutes and then hot for 10 minutes, and is then soaped for 20 minutes at the boil. Finally, the dyeing is again rinsed at the boil and cold and dried. A level and fast blue dyeing on the cotton is obtained. The handle of the goods is pleasantly soft.

When dyeing is carried out in the same way but without preparation (2), the dyeing is not level and the handle of the goods is distinctly harder.

EXAMPLE 5

In a cheese dyeing apparatus, 100 kg of mixed yarn consisting of 66% of polyester and 34% of raw cotton are wetted in 2,000 l of water at 60° C., with the addition of 3,000 g of preparation (14). 2,000 g of a dye mixture consisting of 64 parts of a vat dye of the formula

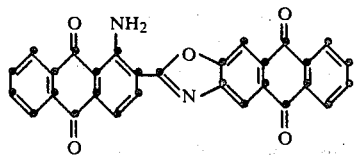
(103)

16 parts of a disperse dye of the formula

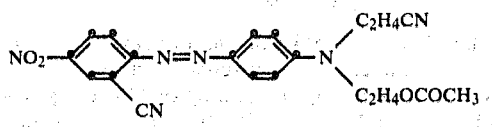
(104)

and 20 parts of a disperse dye of the formula

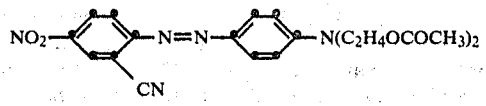
(105)

and 4,000 g of ammonium sulfate are then added to the liquor.

The dye liquor is heated up to 130° C. in the course of 45 minutes and the goods to be dyed are dyed for 60 minutes at this temperature. The dye liquor is then cooled to 70° C., after which the following additives are added to the dyebath: 30 l of 30% sodium hydroxide solution, 6 kg of 86% hydrosulfite and 10 kg of sodium chloride.

The goods are then dyed for a further 45 minutes at 70° C. The liquor is then cooled and the dyed goods are rinsed.

The dyed goods are again rinsed cold, with the addition of 5 kg of sodium carbonate, and oxidised for 20 minutes at 50° C. with 8 l of hydrogen peroxide (30%). Finally, the dyed goods are soaped for a further 15 minutes at the boil and rinsed warm and cold. After removing the water and drying, a level and fast red dyeing of the yarn is obtained. The goods are free from lime deposits and have a pleasantly soft handle.

EXAMPLE 6

In a beam dyeing apparatus, 100 kg of a fabric of raw cotton are wetted in 1,000 liters of water at 50° C. with the addition of 2,000 g of preparation (16). 1,000 g of a direct dye of the formula

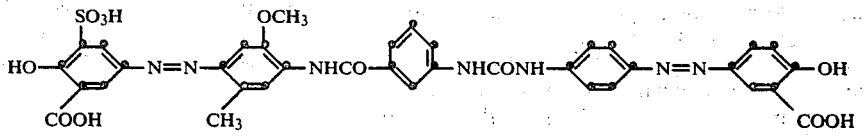
(106)

are then added in the form of a solution.

The dye liquor is heated to the boil in the course of 30 minutes and this temperature is maintained for 15 minutes. 10 kg of Glauber salt are then added in four portions, at intervals of 5 minutes dyeing time, to the dye liquor. After a total boiling time of 45 minutes, the goods are rinsed and then subjected to an after-treatment with 2,000 g of a formaldehyde/dicyandiamide/ethylenediamine condensation product at 40° C. for 10 minutes. A fast yellow dyeing on the cotton is obtained. The goods are free from deposits and alkaline earth metal salts.

In place of the product prepared according to Method B, the same amount, in each case, of one of the carboxyl group-containing polypropylene oxide adducts prepared according to Methods C to F can be employed with similar success in preparation (2) of Examples 2 and 4 and in preparation (15) of Example 2.

What is claimed is:

1. A process for dyeing cellulosic textile material, which has not been pre-cleaned, with a vat dye or an anionic dye, which comprises dyeing the cellulose in the presence of polymaleic acid with a molecular weight of 300 to 5,000 or of an anhydride or salt thereof.

2. A process according to claim 1, wherein the cellulose is dyed in the presence of polymaleic acid, or a water-soluble salt thereof.

3. A process according to claim 1, wherein the dyeing is carried out by the exhaustion process.

4. A process according to claim 1, wherein 0.1 to 3 g of the polymaleic acid are used per liter of dye liquor, based on the solids content of the anhydride.

5. A process according to claim 1, wehrein the dye liquor additionally contains at least one further assistant.

6. A process according to claim 5, wherein the additional assistant is selected from the group consisting of an anti-static agent, diffusion accelerator, dispersing agent, levelling agent, emulsifier, de-aerating agent, anti-crease agent, wetting agent, anti-foam, detergent and agent for imparting a soft handle.

7. A process according to claim 6, wherein the additional assistant is selected from the group consisting of a levelling agent, dispersing agent, anti-crease agent, wetting agent and detergent.

8. A process according to claim 6, wherein the levelling or anti-crease agent is a polypropylene oxide adduct, or a salt thereof, which contains carboxyl groups and has been prepared from (a) about 1 mole of an aliphatic diol which has an average molecular weight of not more than 2,600,
(b) about 2 moles of an aliphatic dicarboxylic acid, or its anhydride, having 4 to 10 carbon atoms,
(c) about 1 mole of an adduct of propylene oxide with an aliphatic alcohol which is at least trihydric and has 3 to 10 carbon atoms and
(d) and about 1 to 2 moles of a fatty acid having 8 to 22 carbon atoms.

9. A process according to claim 8, wherein the adduct has been prepared from (a) an aliphatic diol of the formula $$HO\text{-}(CH_2CH_2O)_n\text{-}H$$

in which n is 10 to 40, (b) a saturated or ethylenically unsaturated aliphatic dicarboxylic acid, or its anhydride, having 4 to 10 carbon atoms, (c) an adduct of propylene oxide with a trihydric to hexahydric alkanol having 3 to 6 carbon atoms and (d) a saturated or unsaturated fatty acid having 12 to 22 carbon atoms.

10. A process according to claim 9, wherein the adduct has been prepared from 1 mol of the condensation product of 1 mol of pentaerythritol and 4 to 8 mols of propylene oxide, 2 mols of maleic anhydride, 1 mol of polyethylene glycol with an average molecular weight of 1,500 and 1 mol of stearic acid.

11. A process according to claim 6, wherein the dispersing agent is a reaction product of an aromatic sulfonic acid and formaldehyde.

12. A process according to claim 6, wherein the dispersing agent used is a reaction product of an aromatic sulfonic acid, formaldehyde and a monofunctional or bifunctional phenol.

13. A process according to claim 6, wherein an anionic or non-ionic surfactant, or a mixture of these surfactants, is used as a dispersing agent, emulsifier, levelling agent, wetting agent and detergent.

14. A process according to claim 5, wherein the additional assistant is used in an amount of 0.05 to 3 g per liter of dye liquor, based on the solids content of the assistant.

15. A process according to claim 1, wherein dyeing is carried out with substantive dyes, leuco vat esters, vat dyes or reactive dyes.

16. A process according to claim 1, wherein dyeing is carried out at a pH value of the dye liquor of 6 to 12.5.

17. A process according to claim 1, wherein the cellulose material is raw cotton.

18. An aqueous dye liquor for dyeing textile cellulose material, which comprises at least one vat dye or anionic dye and polymaleic acid or an anhydride or salt thereof.

19. An aqueous preparation, which comprises 40 to 70 percent by weight of hydrolysed polymaleic anhydride, 5 to 50 percent by weight of a further assistant, 5 to 40 percent by weight of water and 0 to 30 percent by weight of a base.

* * * * *